United States Patent [19]

Hinrichs

[11] Patent Number: 4,731,597

[45] Date of Patent: Mar. 15, 1988

[54] ELECTROMAGNETIC RELAY

[75] Inventor: Fritz Hinrichs, Wolfratshausen, Fed. Rep. of Germany

[73] Assignee: Siemens Aktiengesellschaft, Berlin and Munich, Fed. Rep. of Germany

[21] Appl. No.: 917,972

[22] Filed: Oct. 14, 1986

[30] Foreign Application Priority Data

Oct. 30, 1985 [DE] Fed. Rep. of Germany ..... 3538636

[51] Int. Cl.[4] ..... H01H 67/02

[52] U.S. Cl. ..... 335/128; 335/78; 335/85; 335/281

[58] Field of Search ..... 335/78, 80, 81, 82, 335/83, 85, 84, 121, 124, 128, 281, 297, 203

[56] References Cited

U.S. PATENT DOCUMENTS 4,551,698 11/1985 Aidn ..... 335/78

4,577,172 3/1986 Schedele et al. ..... 335/81

FOREIGN PATENT DOCUMENTS 3128516 2/1983 Fed. Rep. of Germany .

3406832 8/1984 Fed. Rep. of Germany .

*Primary Examiner*—E. A. Goldberg

*Assistant Examiner*—Lincoln Donovan

*Attorney, Agent, or Firm*—Hill, Van Santen, Steadman & Simpson

[57] ABSTRACT

A relay includes a coil member having a base body with a contact space at one end containing two cooperating contact elements, and an elongated contact spring extending next to the coil. The principal plane of each of an angular yoke, an angled armature seated at the yoke, a contact spring, and a connecting plate electrically and mechanically connected to the contact spring are all perpendicular to the connecting plane of the relay. The connecting plate has a U-shaped profile and surrounds the contact spring so that together with the base body, the contours of the cuboid housing are formed which is sealed with foil.

13 Claims, 6 Drawing Figures

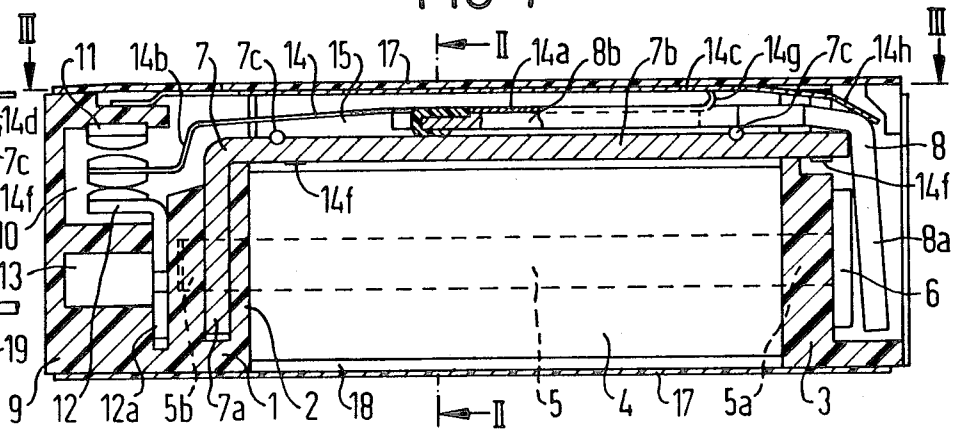
FIG 1
FIG 2
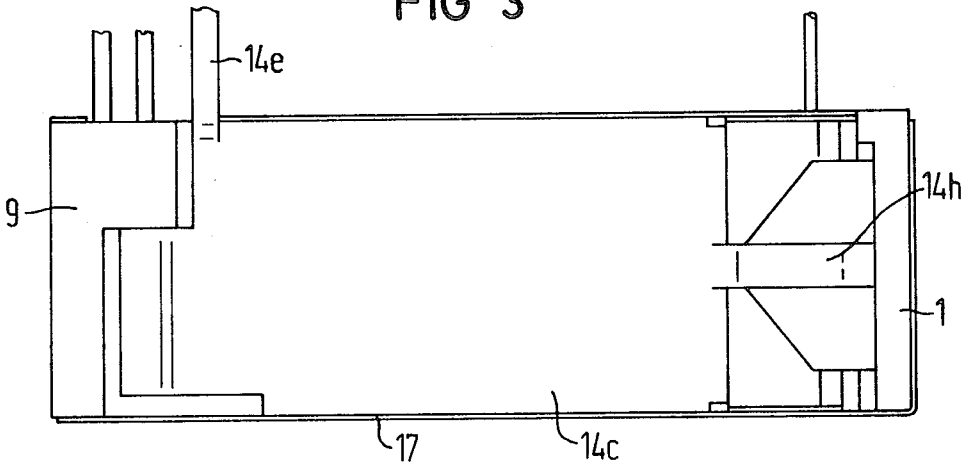
FIG 3

ELECTROMAGNETIC RELAY

BACKGROUND OF THE INVENTION

1. Field of the Invention

The present invention relates to an electromagnetic relay, and more particularly, to a relay coil and yoke arrangement having a contact spring extending essentially parallel to the coil axis.

2. Description of the Prior Art

An electromagnetic relay is disclosed in German Pat. No. OS 34 06 832. A long leg of the armature, together with the contact spring actuated by the armature, is arranged above the relay coil. The contact spring requires relatively long terminal lugs extending to the connecting, or mounting, side of the relay. The long terminal lugs require insulation from the coil when higher voltages are switched by the relay, the insulation in turn requiring additional space within the relay. A housing formed of a pedestal and a cap is used to enclose the relay for protection from the environment, the housing also increasing the total volume required by the relay. In the disclosed relay, it would not be possible to provide a separation between the coil winding and the space provided for the contacts without further ado, nor would it be possible to embed the coil winding in a casting compound, such as is desirable in some applications for insulation and heat dissipation.

Essentially the same problems are present in a relay disclosed in German Pat. No. OS 31 28 516. The disclosed relay has a flat armature and a contact spring arranged above the coil which increases the overall height of the relay since the working air gap for the contact spring is also above the coil Structural protection for the relay is only possible by the provision of an additional housing. Also, separation between the coil winding and the contact space, as well as casting out of the coil winding, is not possible without considerable extra effort.

SUMMARY OF THE PRESENT INVENTION

An object of the present invention is to provide a relay using the least possible number of parts and with the smallest possible volume. Good insulation is provided between the functional parts, particularly between the winding and the contact elements. Sealing of the contact space from the outside and from the coil winding, as well as encasing the coil on a casting compound, is possible without the use of specially shaped housing elements, such as a cap and pedestal.

These and other objects are achieved in accordance with the present invention, whereby the yoke, the armature, contact spring, and the cooperating contact elements have their principal planes next to the coil winding and perpendicular to the mounting plane for the relay. The contact spring of the present relay is connected to a connecting plate which, together with a long leg portion of the yoke, forms a channel for a long leg portion of the armature, as well as for the contact springs. The connecting plate forms a lateral external wall for the relay and, together with the coil member, establishes the contours of a cuboid housing for the relay. Foil is glued over at least two sides of the cuboid housing to cover any openings therein, except at the connecting side of the relay, and thereby form the external cover for the relay. A connecting barb is applied to the underside.

The connecting plate of the present relay has at least an L-shape, and preferably a U-shape. The center portion of the connecting plate forms the lateral external housing wall of the relay. In the preferred embodiment, foil is placed over at least three sides of the housing.

In the relay, thus, the long yoke leg, together with the armature leg extending parallel thereto, and the contact spring, are not arranged above the coil but instead are provided to the side of the coil. As a consequence of the U-shaped connecting plate connected to the contact spring, a channel is formed for the contact spring, which also provides a portion of the housing. The connecting plate is, thus, immediately perpendicular to the mounting side of the relay with its contact terminals. Together with the coil member, the connecting plate defines the contours of the housing without which a separate housing cap would be required. Thus, since the housing contours are already defined by the coil member and the connecting plate, a foil is simply placed around the open housing sides for the exterior of the relay. This foil is far simpler to manufacture and apply than a pedestal member with a housing cap and, moreover, has the significant advantage of requiring less volume than a separate housing, as well as eliminating the intervening spaces normally present between the housing and the body of the relay.

Expediently, the long yoke leg extends across the full height of the relay with side portions of the connecting plate extending flush against the long sides of the yoke leg. In this way, a partition extends between, on one hand, the winding space and, on the other hand, the contact space in conjunction with the channel for the contact spring and the armature so that the winding space can be filled with a casting compound from the connection side of the relay. The spaces containing the movable parts of the relay are, thereby, closed both to the outside as well as to the winding space. The legs of the U-shaped connecting plate, together with the yoke, provide a seating surface to which the foil is glued. Bosses impressed on the yoke can serve as seating points for the legs of the connecting plates to prevent the connecting plate from bowing, or sagging, inwardly. A further protection against pulling of the connecting plate from the yoke is offered by retaining shackles which embrace the yoke from the side portions of the connecting plate.

In one embodiment of the invention, the connecting plate is formed separately from the contact spring and is later connected to the spring by welding. In this embodiment, the sheet from which the contact plate is formed can be stiffer than the material of the contact spring, if necessary, and can be even formed of a different material. However, to employ the fewest number of parts of the present relay, the contact spring of a preferred embodiment is formed as one piece with the connecting plate. The connecting plate is in communication with the contact spring by a hair pin-shaped bend. The contact spring extends within the U-shaped profile of the connecting plate and can be provided with laterally bent webs to give a slight thickness to the contact spring and an enlarged cross-section as required to reduce electrical resistance.

The contact spring is actuated by the long leg of the armature which extends into the channel formed by the connecting plate. To reduce friction, an insulating foil can be arranged between the armature and the contact spring. An even bigger advantage is realized when an insulator part is sprayed onto the armature leg or is plugged onto the armature leg.

In each embodiment, a relay is provided having a long channel for the contact spring disposed alongside the coil, the spring capable of being designed relatively long and flexible as needed. By appropriate selection of the width and thickness of the spring, as well as the materials of which it is formed, many possibilities for setting the electrical and mechanical properties thereof are available. It is also possible to match the contact spring to the magnetic system by an appropriate selection of the attack point between the armature and the contact spring.

BRIEF DESCRIPTION OF THE DRAWINGS

FIG. 1 is a horizontal cross-section along lines I—I of FIG. 2 through a relay according to the principles of the present invention;

FIG. 2 is a cross-section along lines II—II in FIG. 1 of the present relay;

FIG. 3 is a cross-section along lines III—III of FIG. 1 showing a side view of the present relay with the covering foil removed;

DESCRIPTION OF THE PREFERRED EMBODIMENTS

Figure 4:
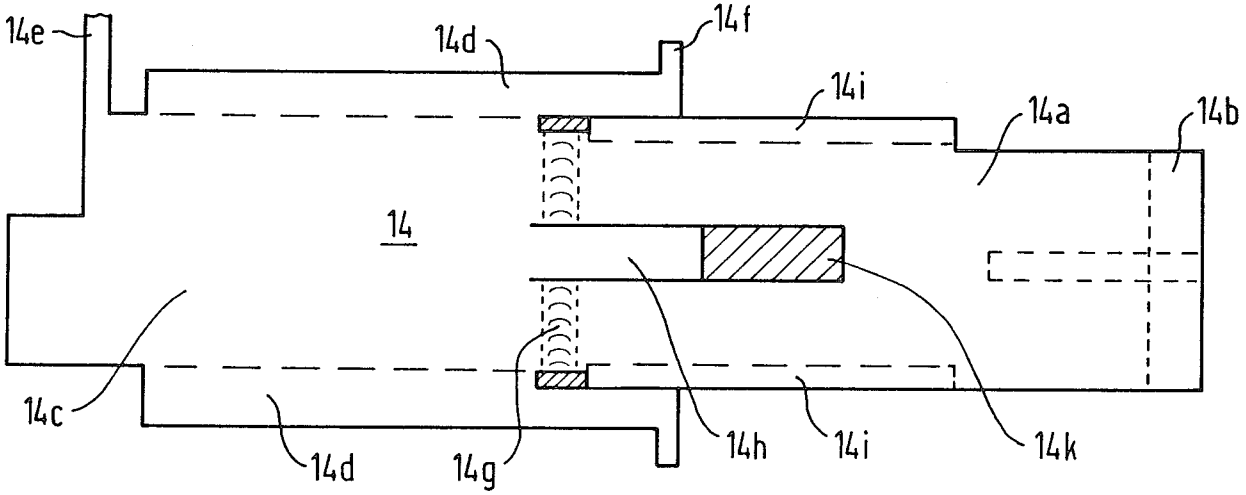
FIG. 4 is a plan view of a contact spring from the relay of FIG. 1, showing its dimensions before folding.

The relay shown in FIGS. 1 through 3 includes a base body 1 serving as a coil member and having flanges 2 and 3 between which is a coil winding 4. A core 5 is either pressed into or injected into the coil member 1, the core having a pole plate 6 at a first end 5*a* in front of the coil flange 3. A second end 5*b* of the core 5 is coupled to a cross leg 7*a* of an angular yoke 7. The end 5*b* of the coil 5 projects beyond the yoke leg 7*a* and into a recess in the coil member 1 for greater stability. The angular yoke 7 has a long leg 7*b* extending above the coil member 1 and parallel to its axis. The long leg 7*b* extends up to the coil flange 3 and forms a knife-edge bearing for an angled armature 8 whose cross leg 8*a* forms a working air gap with the pole plate 6. The angled armature 8 also has a narrow long leg 8*b* disposed parallel to the long yoke leg 7*b* and slightly spaced therefrom.

In front of the flange 2, the coil member 1 includes a shoulder 9 which forms a contact chamber 10. Two cooperating contact elements 11 and 12 are plugged into the chamber 10, the slots for the cooperating contact elements 11 and 12 being provided with sealing lips (not shown) such as, for example, the slot for the cooperating contact element 12 being provided in an oblong hole in the axial direction of the contact piece. In this way, the cooperating contact element 12 can have a connecting portion 12*a* shifted either in the direction toward the cooperating contact element 11 or shifted away from the contact element 11 in order to set the contact distance. A recess 13 is provided in the base body 1 into which an adjustment tool can be introduced. Later, the chamber 13 can accept, for example, a getter member or degasser.

A center contact spring 14 is bent into a hair pinshape and lies essentially parallel to the axis of the coil 1 and to the long legs 7*b* and 8*b* of the yoke and armature, respectively. A region 14*a* of the contact spring 14 forms the actual spring section, while an end 14*b* of the contact spring 14 is crimped and projects between the cooperating contact elements 11 and 12 to form a switch over contact. The armature leg 8*b* attacks, or abuts, the contact spring 14 at a suitable point.

A connecting plate 14*c* is connected to the contact spring 14 and extends parallel thereto, as well as parallel to the long legs 7*b* and 8*b* of the yoke 7 and armature 8, respectively. The connecting plate 14*c*, together with side parts 14*d* at each side, forms a channel 15 with the long yoke leg 7*b*, the armature leg 8*b* and the contact spring portion 14*a* moving freely in the channel 15. The yoke 7, the armature 8, the contact spring 14, together with the connecting plate 14*c*, all are disposed perpendicular to the connecting plane or base plane of the relay. The connecting plate 14*c* forms a lateral external wall to which a terminal pin, or barb, 14*e* is directly applied in downward fashion. The connecting plate 14*c* and the side parts 14*d* have a U-shaped profile which protects the contact spring leg 14*a* against outside mechanical influences while simultaneously increasing the cross-section through which power is fed.

Impressions 7*c* are applied to the yoke leg 7*b* to guide the lateral part 14*d* and secure it against inward dislocation so that the lateral parts 14*d* have their edges flush with the side faces of the yoke leg 7*b*. To resist outwardly directed forces and to prevent the connecting plate 14*c* from being lifted from the yoke leg 7*b*, lateral retaining tabs 14*f* are included on the connecting plate 14*c* embracing the yoke 7 in the manner of spring clips.

With reference to FIG. 4, the one-piece contact spring 14 and connecting plate 14*c* element is shown at an early stage of its manufacture. First, the overall contour of the spring 14 is cut free and then the spring is bent and folded along a bending zone 14*g*. At the contacting end 14*b* of the actual spring section 14*a*, a split may be provided as shown in dotted outline to form a double contact. In the midregion, a rectangular piece which forms an armature restoring spring 14*h* is cut free and is bent somewhat out of line with the contact spring 14. To compensate for the cross-sectional attenuation of the contact spring section 14*a* caused by the removal of the restoring spring 14*h*, additional lateral webs 14*i* are provided, the webs 14*i* being angled downward to such a degree toward the yoke 7 that they influence the stiffness of the contact spring 14 yet do not strike the lateral parts 14*d* of the connecting plate 14*c*, nor the yoke leg 7*b*.

As seen in FIG. 2, an actuation member 16 of plastic is applied to or plugged onto the armature 8 for actuation of the contact spring 14. The actuation member 16 engages a cutout recess 14*k* of the contact spring section 14*a*, shown cross-hatched in FIG. 4. Instead of the actuation member 16, a foil can also be introduced between the armature leg 8*b* and the contact spring section 14*a*.

Referring again to FIGS. 1–3, the coil member or base body, along with the flanges 2 and 3 and the shoulder 9, and together with the yoke leg 7*b* in the U-shaped connecting plate 14*c* form the outside contours of a cuboid housing, cuboid being defined herein as a rectangular parallelepiped. In particular, all housing corners are prescribed while the intervening wall portions have the necessary openings through which are introduced the functional elements of the relay. The housing can be closed by applying a foil 17, which is simply placed around the contours of the base body 1 and the connecting plate 14c and folded over the edges. Depending on how many assembly openings are present in the base body 1, the foil 17 is placed over at least 3 and potentially over 5 sides of the base body 1 and then glued down or welded on. The foil 17 can be formed with or without a coating or as a two layer foil or can be partially coated with glue.

Due to the shape of the yoke 7 in combination with the coil flanges 2 and 3 and the connecting plate 14c, the contact chamber 10 sealed relative to the outside and relative to the coil space 18 yet remains in communication with the spring channel 15. The coil space 18 remains free at a connecting side 19 of the relay, since the foil 17 does not cover this side. Thus, the coil space 18 can be filled with a casting compound from the connecting side 19 to increase the insulation for the relay, improve the heat dissipation of the coil, and affect a sealing of the contact space 10 and the spring channel 15.

Figure 5:
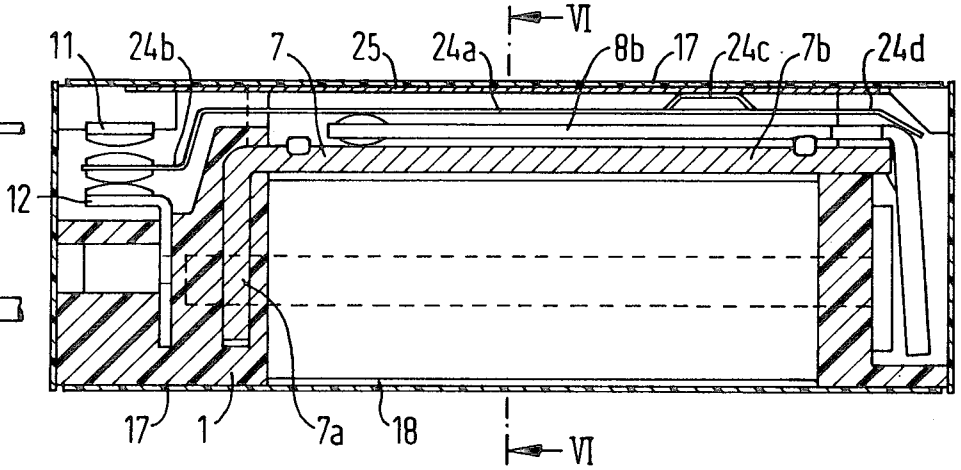
FIG. 5 is a horizontal cross-section of a second embodiment of a relay of the present invention.
Figure 6:
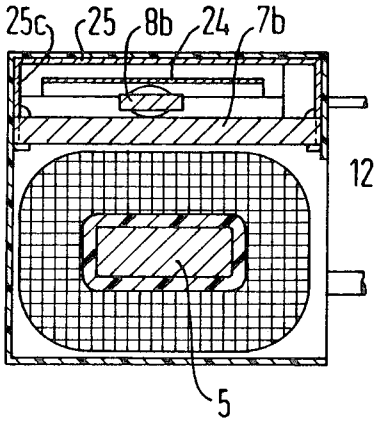
FIG. 6 is a cross-section along lines VI—VI of FIG. 5 of the present relay.

A somewhat modified embodiment of the relay of FIGS. 1 through 3 is shown in FIGS. 5 and 6. Insofar as the parts of this relay coincide with the elements of the relay of FIGS. 1 through 3, the same reference numerals apply. Differing from the preceding example is the formation of a contact spring 24 which has a section 24a extending roughly parallel to the armature leg 7b and a contacting edge 24b disposed between two cooperating contact elements 11 and 12. A connecting plate 25 is not formed in one piece with the contact spring 24, but instead is manufactured separately and may be of some other material. For example, the thickness of the connecting plate 25 can be selected to differ from the thickness of the contact spring 24.

The structure of the connecting plate 25 is essentially identical to the connecting plate 14c of the preceding example. Thus, the connecting plate 25 also includes side portions 25c which form a U-shaped cross-section to surround the spring channel 15 as described hereinabove. The contact spring 24 is secured by a section 24c at the connecting plate 25, the section 24c having been cut free, bent up, and secured, such as by welding or some other fastening method. Both a mechanical and an electrical connection is produced at the connection of the section 24c. An applied spring section 24d serves as the armature restoring spring just as the spring section 14h does above. The relay is mounted as set forth above and is closed with a foil 17, with the coil space 18 preferably being filled with casting compound.

Although modifications and changes may be suggested by those skilled in the art, it is the intention of the inventor to embody within the patent warranted hereon all changes and modifications as reasonably and properly come within the scope of his contribution to the art.

I claim as my invention:

1. An electromagnetic relay having a connecting plane, comprising:

a coil member having an axially extending core and a winding;

an angular yoke having a long leg extending parallel to the axis of said coil;

an angled armature seated at an end edge of said long leg of said yoke and having a long armature leg;

a contact spring extending substantially parallel to said long leg of said yoke and to said long armature leg and having a contact spring leg;

an end face shoulder formed as an extended portion at an end of said coil member;

at least one cooperating contact element anchored in said end face shoulder;

said contact spring interacting with said at least one cooperating contact element;

said angular yoke and said angled armature and said contact spring each having a principal plane next to said winding and substantially perpendicular to the relay connecting plane;

a connecting plate connected to said contact spring and forming a channel between said connecting plate and said long yoke leg for said long armature leg and for said contact spring leg, said connecting plate forming a lateral terminating wall of said relay;

a terminal pin connected to said connecting plate for electrical communication with said contact spring and extending from an underside of said relay;

said coil member and said connecting plate forming the contours of a cuboid housing;

foil applied over at least two sides of said cuboid housing covering openings in said housing; and said underside of said relay being free of said foil.

2. An electromagnetic relay as claimed in claim 1, wherein said connecting plate has an L-shape.

3. An electromagnetic relay as claimed in claim 1, wherein said connecting plate has a U-shape, a middle portion of said U-shaped connecting plate forming a lateral terminal wall of said relay, and wherein said foil is over at least three sides of said housing.

4. An electromagnetic relay as claimed in claim 3, wherein said long yoke leg extends over the full height of said relay, and wherein side portions of said U-shaped connecting plate extend flush with the longitudinal sides of said relay.

5. An electromagnetic relay as claimed in claim 3, wherein bosses are impressed on said yoke to provide seating points for side portions of said U-shaped connecting plate.

6. An electromagnetic relay as claimed in claim 3, wherein side portions of said U-shaped connecting plate include retaining shackles for embracing said yoke.

7. An electromagnetic relay as claimed in claim 1, wherein said connecting plate is initially formed separately from said contact spring and is subsequently connected to said contact spring.

8. An electromagnetic relay as claimed in claim 1, wherein said contact spring is formed in one piece with said connecting plate.

9. An electromagnetic relay as claimed in claim 8, wherein said connecting plate is connected to said contact spring by a hair pin-shaped bend.

10. An electromagnetic relay as claimed in claim 8, wherein longitudinal sections of said contact spring are provided with lateral bent webs.

11. An electromagnetic relay as claimed in claim 1, wherein an insulator foil is disposed between said long leg of said armature and said contact spring.

12. An electromagnetic relay as claimed in claim 1, further comprising: an actuation member of insulating material provided at said long leg of said armature.

13. An electromagnetic relay as claimed in claim 3, wherein said coil member and said yoke form a partition between said coil space and the space containing said contact elements and said armature, and further comprising:

a casting resin filling said coil space.

* * * * *